US007869611B2

(12) United States Patent
Asada

(10) Patent No.: US 7,869,611 B2
(45) Date of Patent: Jan. 11, 2011

(54) TEST TONE DETERMINATION METHOD AND SOUND FIELD CORRECTION APPARATUS

(75) Inventor: Kohei Asada, Kanagawa (JP)

(73) Assignee: Sony Corporation, Tokyo (JP)

( * ) Notice: Subject to any disclaimer, the term of this patent is extended or adjusted under 35 U.S.C. 154(b) by 1139 days.

(21) Appl. No.: 11/529,940

(22) Filed: Sep. 29, 2006

(65) Prior Publication Data

US 2007/0086595 A1 Apr. 19, 2007

(30) Foreign Application Priority Data

Oct. 13, 2005 (JP) ..... 2005-298345

(51) Int. Cl.
*H04R 5/02* (2006.01)
*H04R 3/00* (2006.01)

(52) U.S. Cl. ..... 381/303; 381/92; 381/122

(58) Field of Classification Search ..... 381/303, 381/92, 122, 111, 101, 102, 103, 56, 58, 381/59, 95, 96; 333/28 T; 455/267
See application file for complete search history.

(56) References Cited

U.S. PATENT DOCUMENTS 6,792,118 B2 * 9/2004 Watts ..... 381/92

FOREIGN PATENT DOCUMENTS

JP 2000-261900 A 9/2000
JP 2005-341534 A 12/2005

* cited by examiner

*Primary Examiner*—Vivian Chin
*Assistant Examiner*—Douglas J Suthers
(74) *Attorney, Agent, or Firm*—Wolf, Greenfield & Sacks, P.C.

(57) ABSTRACT

A test tone determination method includes picking up a test tone output from a speaker; calculating first and second distances from the speaker to first and second microphones and a distance difference between the first and second distances; determining whether or not the distance difference is smaller than or equal to a predetermined distance between the first and second microphones; determining amplitudes to be amplitudes of direct waves of the test tone, when the distance difference is smaller than or equal to the predetermined distance; performing scanning, with respect to an amplitude found later, on a portion corresponding to a portion near the amplitude found earlier, when the distance difference is larger than the predetermined distance; and determining an amplitude found in the portion corresponding to the portion near the amplitude found earlier and the amplitude found earlier to be amplitudes of the direct waves of the test tone.

8 Claims, 6 Drawing Sheets

TEST TONE DETERMINATION METHOD AND SOUND FIELD CORRECTION APPARATUS

CROSS REFERENCES TO RELATED APPLICATIONS

The present invention contains subject matter related to Japanese Patent Application JP 2005-298345 filed in the Japanese Patent Office on Oct. 13, 2005, the entire contents of which are incorporated herein by reference.

BACKGROUND OF THE INVENTION

1. Field of the Invention

The present invention relates to a test tone determination method and a sound field correction apparatus using the test tone determination method.

2. Description of the Related Art

Due to prevalence of digital versatile discs (DVD) and digital broadcasting, multichannel audio systems, such as home theater systems, are becoming widely used in homes. In such situations, there is an increased demand for users to perform setting of each channel and setting between channels, such as setting of volume balance and frequency characteristics, in multichannel audio systems.

However, since setting and adjustment in multichannel audio systems are complicated, listeners (or users) who are not familiar with such operations may feel puzzled. Thus, in order to simplify or eliminate the necessity for setting and adjustment by listeners, there is a trend in which, when audio playback is performed, an apparatus, such as an AV (audio and visual) amplifier, constituting a multichannel audio system performs correction processing.

Such correction processing is called "automatic sound field correction" or the like. In such correction processing, acoustic conditions of a playback sound field are automatically measured and analyzed, and sound field correction is performed in accordance with an analysis result. That is, in general, as shown in FIG. 4A, the correction processing described below is performed.

(A) A predetermined test tone is output from a speaker SP for a certain channel. An impulse signal, a time stretched pulse (TSP) signal, or a burst wave signal is used as a test tone.

(B) The test tone mentioned in (A) is picked up by a microphone M0 set at the listening position of a listener.

(C) A rising point of an output signal of the microphone M0 is analyzed, and a distance from the speaker SP to the microphone M0 is calculated.

(D) Processing in (A) to (C) is performed for other channels.

(E) An audio signal is processed such that a constant delay time can be achieved between speakers for the individual channels to the listening position (microphone M0) in accordance with results acquired by the processing (D).

In addition, as shown in FIG. 4A, a method for setting microphones M1 and M2, which serve as sound pickup microphones, at the listening positions of a listener and for calculating the distance and angle (direction) between the speaker SP and each of the microphones M1 and M2 using triangulation is also available.

Known technologies are described, for example, in Japanese Unexamined Patent Application Publication No. 2000-261900 and Japanese Patent Application No. 2005-141615 (specification and drawings).

When the distance from the speaker SP to the microphone M0 is measured, variation, peaks, dips, and the like in the frequency characteristics in a playback sound field may affect a measurement result.

In that respect, when the distance from the speaker SP to each of the microphones M1 and M2 is measured, variation, peaks, dips, and the like in the frequency characteristics in a playback sound field may be flexibly coped with. Thus, more appropriate sound field correction can be achieved. It is desirable that sound field correction be performed by calculating the distance or angle between the speaker SP and each of the microphones M1 and M2.

However, in the situation shown in FIG. 4B, measurement using the microphones M1 and M2 is not performed successfully. That is, in the situation shown in FIG. 4B, in order to keep a predetermined distance between the microphones M1 and M2, the microphones M1 and M2 are fixed to an arm or the like. In addition, it is assumed that reflectors are located near the microphones M1 and M2 and that an obstacle is located on a virtual line connecting the speaker SP and the microphone M2. Here, furniture, a wall, a ceiling, or the like corresponds to each of the reflectors, and the body of a listener or a family member, furniture, or the like corresponds to the obstacle.

When acoustic waves of a test tone are output from the speaker SP, an acoustic wave W1 directly reaches the microphone M1, and an acoustic wave WQ1 is reflected by one of the reflectors and then reaches the microphone M1. In addition, an acoustic wave W2 is diffracted and attenuated by the obstacle and directly reaches the microphone M2, and an acoustic wave WQ2 is reflected by the other reflector and then reaches the microphone M2. That is, the acoustic waves W1 and W2 are direct waves, and the acoustic waves WQ1 and WQ2 are indirect waves (reflected waves). In this case, due to attenuation, the amplitude of the direct wave W2 is smaller than that of the indirect wave WQ2. In addition, the indirect wave WQ2 is delayed compared with the direct wave W2.

Thus, output signals SM1 and SM2 of the microphones M1 and M2 in this case are as shown in FIG. 5A. That is, FIGS. 5A, 5B, and 5C schematically show envelopes of the output signals SM1 and SM2 of the microphones M1 and M2 when an impulse signal is supplied as a test tone signal to the speaker SP.

In the playback environment shown in FIG. 4B, as the output signal SM1 of the microphone M1, pulse amplitude P1 acquired by picking up the direct wave W1 is obtained, and then, pulse amplitude Q1 acquired by picking up the indirect wave WQ1 is obtained, as shown in FIG. 5A. In addition, as the output signal SM2 of the microphone M2, pulse amplitude P2, which is small, acquired by picking up the indirect wave W2 is obtained, and then, pulse amplitude Q2 acquired by picking up the indirect wave WQ2 is obtained.

FIGS. 6A and 6B show the main portions of wave shapes of the output signals SM1 and SM2 of the microphones M1 and M2 that are actually observed. In FIGS. 6A and 6B, the horizontal axis represents sample numbers when the output signals SM1 and SM2 are sampled at a frequency of 48 kHz. Thus, the horizontal axis also serves as a time axis. Here, a test tone is an impulse signal, and the point in time when the impulse signal is generated serves as the starting point (origin) of the horizontal axis.

As is clear from FIGS. 6A and 6B, in the environment shown in FIG. 4B, the output signal SM1 includes the large amplitude P1 corresponding to the direct wave W1 and the slightly smaller amplitude Q1 corresponding to the indirect wave WQ1. In addition, the output signal SM2 includes the small amplitude P2 corresponding to the attenuated direct wave W2 and the large amplitude Q2 corresponding to the indirect wave WQ2. The amplitude P2 is almost buried in noise.

In the state shown in FIG. 5A (and FIGS. 6A and 6B), when the presence or absence of the amplitudes P1 and P2 is determined on the basis of, for example, a threshold level VTH, the presence of the amplitude Q2 is detected, instead of the amplitude P2. The distance and angle between each of the microphones M1 and M2 and the speaker SP should be calculated on the basis of the impulse signal supplied to the speaker SP and the rising time of each of the amplitudes Pi and P2. However, since the amplitude Q2 is erroneously determined to be the amplitude P2 in the case shown in FIG. 5A, the distance and angle between each of the microphones M1 and M2 and the speaker SP are calculated on the basis of the rising time of the amplitude Q2, instead of the rising time of the amplitude P2. Thus, an error occurs in calculation of the distance and angle.

If the distance from the speaker SP to the microphone M0 is measured as shown in FIG. 4A, calculating the distance on the basis of the rising time of an indirect wave corresponding to the indirect wave WQ1 or WQ2 is not a significant problem. This is because the indirect wave has an energy larger than that of the direct wave at the position of the microphone M0 that picks up the indirect wave. Thus, in terms of sound field correction, a path in which the indirect wave is reflected can also be included for calculation of distance.

However, when distance is calculated with respect to each of the microphones M1 and M2 or with respect to each of a larger number of microphones, erroneous determination of the amplitude Q2 and the amplitude P2 is performed as long as output signals of the individual microphones are analyzed independently. Thus, incorrect distance and angle are calculated from the amplitude P1 and the amplitude Q2.

In addition, in cases other than the case shown in FIG. 5A, mismatching of output signals of the microphones M1 and M2 may occur. For example, when a loud noise is unexpectedly picked up by one of the microphones M1 and M2, a noise signal may be erroneously determined to be an amplitude corresponding to a direct wave.

Alternatively, when sound field correction is performed by analyzing output signals of the microphones M1 and M2, if distance and angle are calculated by using part of the analysis processing, pre-echo may occur before an amplitude corresponding to a direct wave. This pre-echo may be erroneously determined to be an amplitude corresponding to the direct wave. That is, when a TSP signal is used as a test tone, inverse TSP processing is performed in the process of analysis processing to acquire an impulse response. However, if the spatial impulse response does not sufficiently converge with respect to the length of the TSP signal, due to cyclic convolution of frequency transformation (FFT (Fast Fourier Transform)/IFFT (Inverse Fast Fourier Transform)), a false large amplitude (pre-echo) may appear before the amplitude corresponding to the direct wave. The pre-echo may be erroneously determined to be the amplitude corresponding to the direct wave.

FIG. 5B shows an example of the output signals SM1 and SM2 in such a case. In FIG. 5B, a case where, due to noise or pre-echo, amplitude R2 that exceeds the threshold level VTH appears before the amplitude P2 is shown. In this case, the amplitude R2 is erroneously determined to be the amplitude P2. Thus, incorrect distance and angle are calculated from the amplitude P1 and the amplitude R2.

In addition, for example, as shown in FIG. 5C, when the amplitudes P1 and P2 corresponding to the direct waves W1 and W2 are determined, the time difference T12 between the determined amplitudes P1 and P2 may be too large. That is, when "d" represents the distance between the microphones M1 and M2 and "Td" represents the time period necessary for transmission of an acoustic wave over the distance d, that is, the temporal distance between the microphones M1 and M2 with respect to an acoustic wave, the time difference T12 between the amplitudes P1 and P2 reaches maximum when the speaker SP and the microphones M1 and M2 are disposed in a line, and the time difference T12 should not be larger than the time period Td. However, in some cases, such as due to the occurrence of a system error or the presence of an extremely large obstacle, the time difference T12 may be larger than the time period Td.

In a case where erroneous determination of an amplitude corresponding to a direct wave is performed as described above, when output signals of the microphones M1 and M2 are analyzed, a triangle connecting the speaker SP and the microphones M1 and M2 is not formed. Thus, the distance and angle between the speaker SP and each of the microphones M1 and M2 is not calculated correctly.

SUMMARY OF THE INVENTION

It is desirable to perform correct determination of a direct wave and to avoid erroneous determination.

A test tone determination method according to an embodiment of the present invention includes the steps of picking up, by a first microphone and a second microphone that are disposed with a predetermined distance therebetween, a test tone output from a speaker; calculating a first distance from the speaker to the first microphone, a second distance from the speaker to the second microphone, and a distance difference between the first and second distances, in accordance with periods of time necessary for occurrence of a first amplitude and a second amplitude that are larger than a predetermined value in output signals of the first and second microphones; determining whether or not the calculated distance difference is smaller than or equal to the predetermined distance; determining the first and second amplitudes to be amplitudes corresponding to direct waves of the test tone, when the distance difference is smaller than or equal to the predetermined distance in accordance with a determination result of the distance difference; performing scanning, with respect to one of the first and second amplitudes that is found later, on an output signal portion corresponding to an output signal portion near the other one of the first and second amplitudes that is found earlier, when the distance difference is larger than the predetermined distance in accordance with the determination result of the distance difference; and determining an amplitude found in the output signal portion corresponding to the output signal portion near the other one of the first and second amplitudes that is found earlier and the other one of the first and second amplitudes that is found earlier to be amplitudes corresponding to the direct waves of the test tone, when the amplitude found in the output signal portion corresponding to the output signal portion near the other one of the first and second amplitudes that is found earlier is found in accordance with a scanning result.

Accordingly, when the distance and angle between a speaker and a microphone are measured, a direct wave output from the speaker can be correctly determined. Thus, the distance and angle can be correctly measured. Therefore, sound field correction can be properly performed.

DESCRIPTION OF THE PREFERRED EMBODIMENTS

Figure 1:
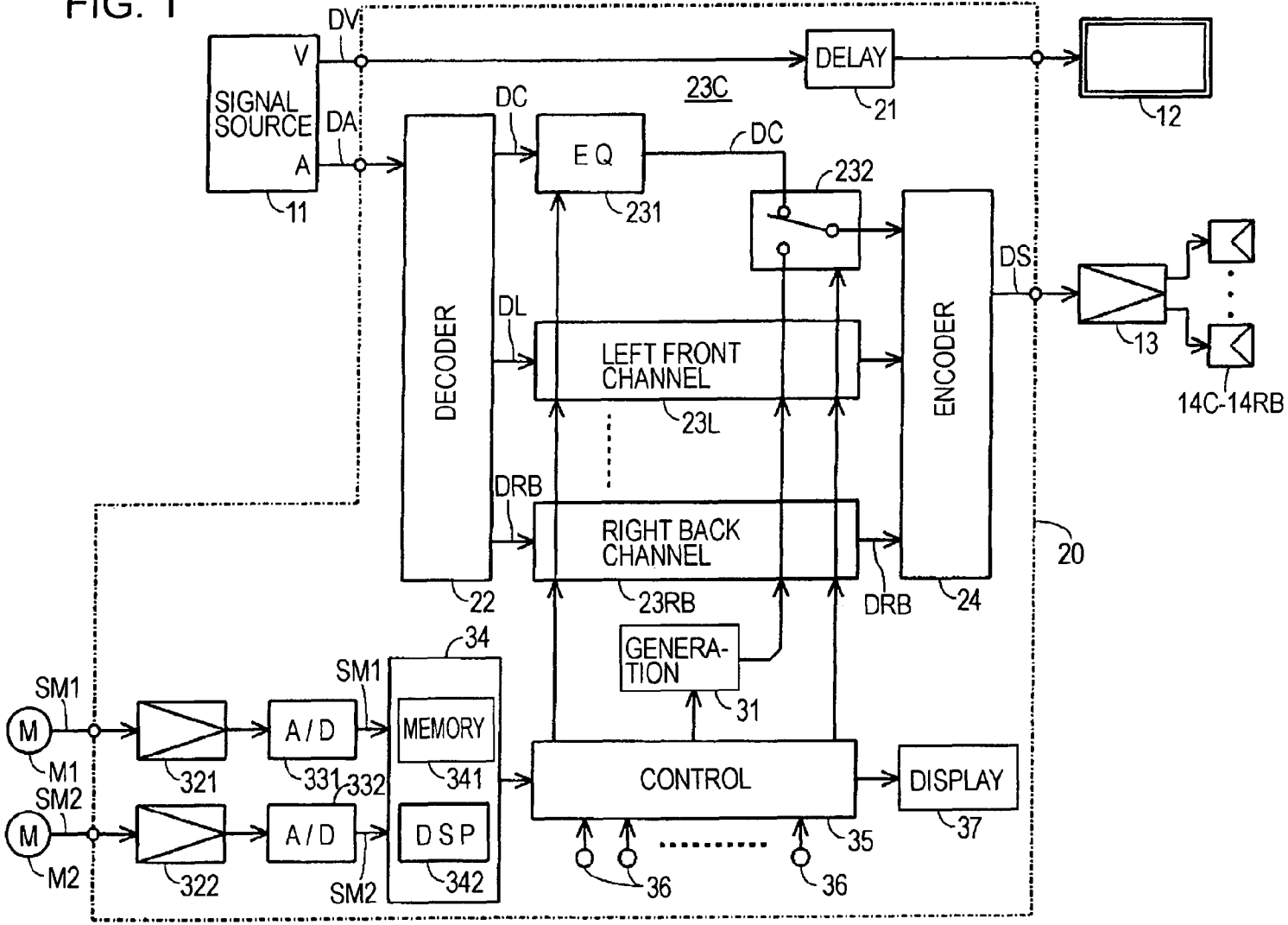
FIG. 1 is a schematic diagram showing an embodiment of the present invention.

The outline of the present invention will be described.

First, output signals of microphones M1 and M2 are considered. When acoustic waves output from a speaker SP reach the microphones M1 and M2 in listening environment, such as a listening room, both a direct wave that reaches the microphone M1 and a direct wave that reaches the microphone M2 are less likely to be largely attenuated by an obstacle. That is, when a test tone output from the speaker SP is picked up by the microphones M1 and M2, both the microphones M1 and M2 are less likely to erroneously detect indirect waves, and at least one of the microphones M1 and M2 correctly picks up a direct wave.

Thus, in an embodiment of the present invention, the above-mentioned erroneous determination is avoided by the method for determining an amplitude corresponding to a direct wave, which will be described later, and determination of an amplitude corresponding to a direct wave is performed correctly.

Although described later, for example, a distance d, which represents the distance between the microphones M1 and M2, is set to 18 cm, and a time period "Td", which represents the time period necessary for transmission of an acoustic wave over the distance d, that is, the temporal distance between the microphones M1 and M2 with respect to an acoustic wave, is set to 0.53 milliseconds.

A method for determining an amplitude corresponding to a direct wave will be described.

First, a case shown in FIG. 5A will be described. In the case shown in FIG. 5A, amplitude P1 is larger than a predetermined threshold level VTH and is acquired before amplitude Q2. Thus, when level determination of an output signal SM1 of the microphone M1 is performed on the basis of the threshold level VTH, the amplitude P1 is found.

However, amplitude P2 corresponding to a direct wave W2 is smaller than the threshold level VTH, and the amplitude Q2, which is larger than the threshold level VTH, is acquired after the amplitude P2. Thus, the amplitude P2 is not found by simple level determination.

In this case, processing (1) to (9) is performed, as described below.

(1) An amplitude (in this case, the amplitude P1) of the output signal SM1 of the microphone M1 that first exceeds the threshold level VTH is tentatively determined to be amplitude V1 corresponding to a direct wave W1.

(2) An amplitude (in this case, the amplitude Q2) of an output signal SM2 of the microphone M2 that first exceeds the threshold level VTH is tentatively determined to be amplitude V2 corresponding to the direct wave W2.

(3) A time difference T12 between the point in time when the amplitude V1 appears and the point in time when the amplitude V2 appears is acquired.

(4) In this case, since the time difference T12 is larger than the time period Td, a triangle connecting the speaker SP and the microphones M1 and M2 is not formed. Thus, the existence of a factor of erroneous determination is recognized.

(5) The point in time when the amplitude V1 appears is compared with the point in time when the amplitude V2 appears.

(6) Since, in this case, the amplitude V1 appears before the amplitude V2, the tentative determination is updated such that the amplitude V1 is the true amplitude P1 corresponding to the direct wave W1. The amplitude P1 will be handled as the reference or index for the subsequent processing.

(7) For a check period ±Td including time periods before and after the amplitude P1, a change in the level of the output signal SM2 of the microphone M2 is observed. The check period ±Td is determined on the basis of the distance d between the microphones M1 and M2. In addition, a threshold level VTL, which is smaller than the threshold level VTH, is used for checking the change of the level.

(8) Since the amplitude P2 is found, the amplitude P2 is duly determined to be an amplitude corresponding to the direct wave W2.

(9) The tentative determination given by (6) that the amplitude P1 is an amplitude corresponding to the direct wave W1 is duly fixed.

Accordingly, the amplitudes P1 and P2 corresponding to the direct waves W1 and W2 can be correctly determined.

Second, a case shown in FIG. 5B will be described. In the case shown in FIG. 5B, the above-mentioned processing (1) to (7) is performed in a similar manner, that is, processing (11) to (20) is performed, as described below.

(11) An amplitude (in this case, the amplitude P1) of the output signal SM1 of the microphone M1 that first exceeds the threshold level VTH is tentatively determined to be the amplitude V1 corresponding to the direct wave W1.

(12) An amplitude (in this case, amplitude R2) of the output signal SM2 of the microphone M2 that first exceeds the threshold level VTH is tentatively determined to be the amplitude V2 corresponding to the direct wave W2.

(13) The time difference T12 between the point in time when the amplitude V1 appears and the point in time when the amplitude V2 appears is acquired.

(14) Since, in this case, the time difference T12 is larger than the time period Td, a triangle connecting the speaker SP and the microphones M1 and M2 is not formed. Thus, the existence of a factor of erroneous determination is recognized.

(15) The point in time when the amplitude V1 appears is compared with the point in time when the amplitude V2 appears.

(16) Since, in this case, the amplitude V2 appears before the amplitude V1, the tentative determination is updated such that the amplitude V2 is the true amplitude P2 (in actual, the amplitude R2) corresponding to the direct wave W2.

(17) For a check period ±Td including time periods before and after the amplitude P2 (=R2), a change in the level of the output signal SM1 of the microphone M1 is observed. The threshold level VTL is used for checking the change of the level. (The processing (11) to (17) is similar to the processing (1) to (7) described above with reference to FIG. 5A.)

(18) Since, in this case, a large level change is not found, for the output signal SM1 of the microphone M1, the tentative determination given by (11) that the amplitude P1 is an amplitude corresponding to the direct wave W1 is duly fixed.

(19) For a check period ±Td including time periods before and after the amplitude P1, a change in the level of the output signal SM2 of the microphone M2 is observed.

(20) Since the amplitude P2 is found, the amplitude P2 is duly determined to be an amplitude corresponding to the direct wave W2.

Accordingly, the amplitudes P1 and P2 corresponding to the direct waves W1 and W2 can be correctly determined.

Third, a case shown in FIG. 5C will be described. In the case shown in FIG. 5C, processing (21) to (30) is performed, as described below.

(21) An amplitude (in this case, the amplitude P1) of the output signal SM1 of the microphone M1 that first exceeds the threshold level VTH is tentatively determined to be the amplitude V1 corresponding to the direct wave W1.

(22) An amplitude (in this case, the amplitude P2) of the output signal SM2 of the microphone M2 that first exceeds the threshold level VTH is tentatively determined to be the amplitude V2 corresponding to the direct wave W2.

(23) The time difference T12 between the point in time when the amplitude V1 appears and the point in time when the amplitude V2 appears is acquired.

(24) Since, in this case, the time difference T12 is larger than the time period Td, a triangle connecting the speaker SP and the microphones M1 and M2 is not formed. Thus, the existence of a factor of erroneous determination is recognized.

(25) The point in time when the amplitude V1 appears is compared with the point in time when the amplitude V2 appears.

(26) Since, in this case, the amplitude V1 appears before the amplitude V2, the tentative determination is updated such that the amplitude V1 is the true amplitude P1 corresponding to the direct wave W1.

(27) For a check period ±Td including time periods before and after the amplitude P1, a change in the level of the output signal SM2 of the microphone M2 is observed. The threshold level VTL is used for checking the change of the level. (The processing (21) to (27) is similar to the processing (1) to (7) described above with reference to FIG. 5A.)

(28) Since, in this case, a large level change is not found, for the output signal SM2 of the microphone M2, the tentative determination given by (22) that the amplitude P2 is an amplitude corresponding to the direct wave W2 is duly fixed.

(29) For a check period ±Td including time periods before and after the amplitude P2, a change in the level of the output signal SM1 of the microphone M1 is observed. (The processing (28) and (29) is similar to the processing (18) and (19) described above with reference to FIG. 5B.) In addition, a threshold level used here is set to be smaller than the threshold level VTL.

(30) Since, in this case, a large level change is not found, it is determined that it is difficult to perform sound field correction due to a system error or an extremely large obstacle. Thus, for example, an error is displayed in order to urge a listener to improve playback environment.

Figure 5A:
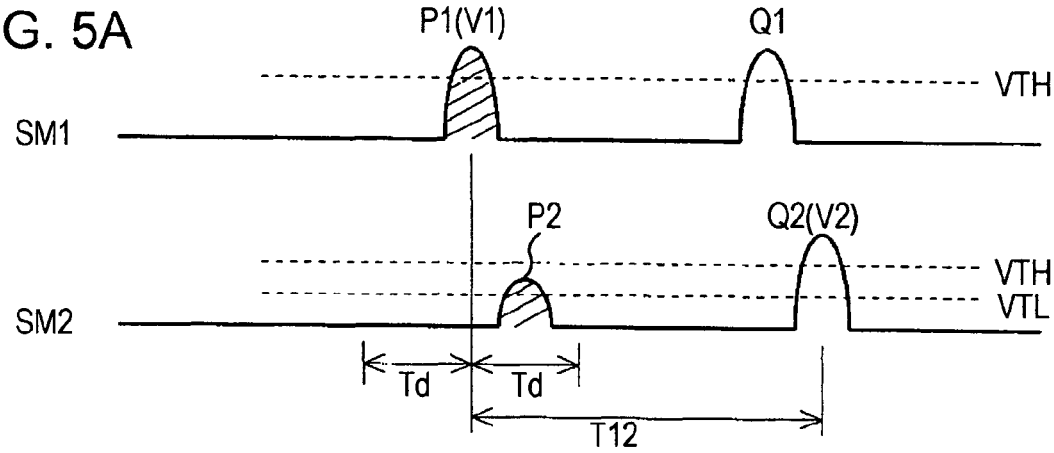
FIGS. 5A to 5C are schematic waveform charts for explaining the embodiment of the present invention.
Figure 5B:
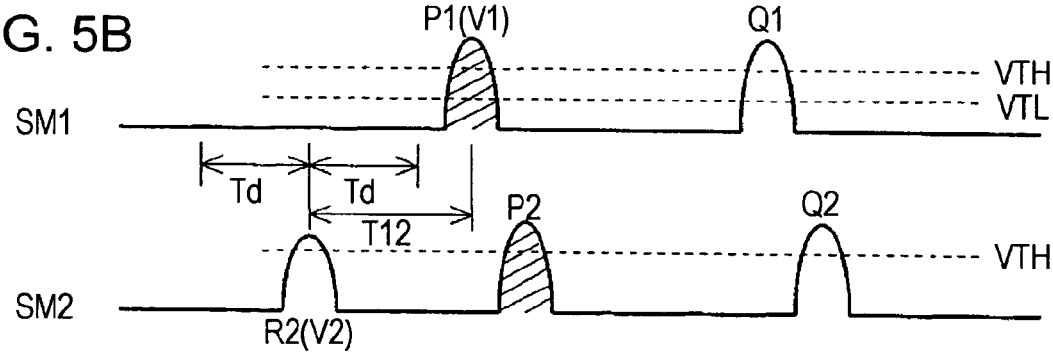
Figure 5C:
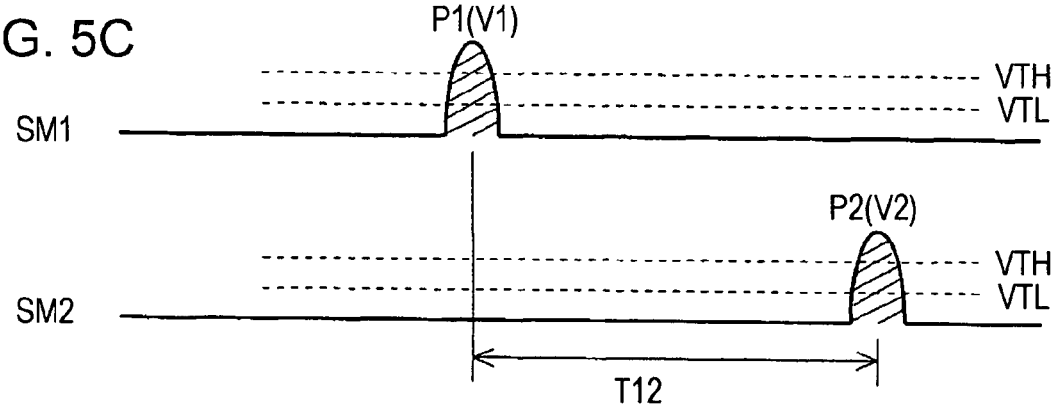
Figure 6A:
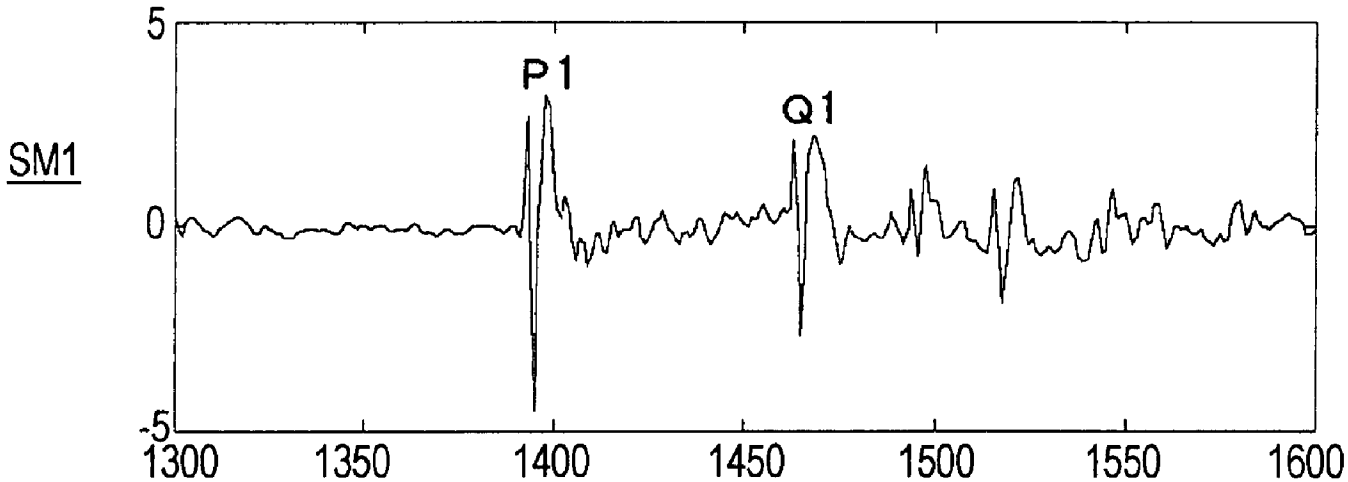
FIGS. 6A and 6B are waveform charts showing a measurement example of sound pickup signals.
Figure 6B:
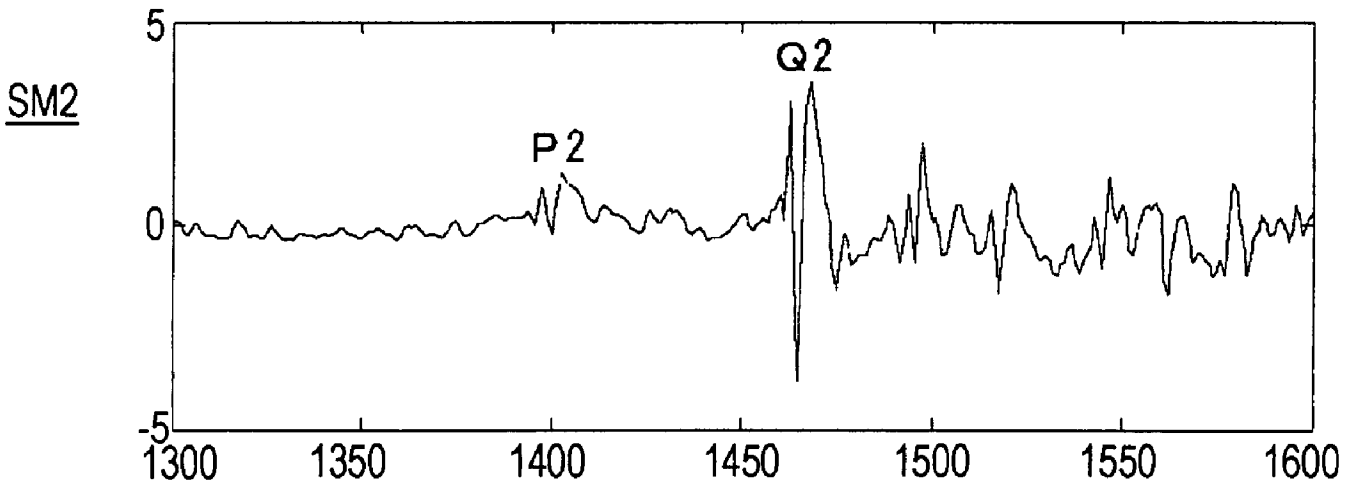

In actual, since discrimination between the case shown in FIG. 5A, the case shown in FIG. 5B, and the case shown in FIG. 5C is necessary, the discrimination will be explained with reference to a flowchart given later. In addition, since time is in proportion to the distance an acoustic wave reaches, distance may be used instead of time.

The structure of a system will be described.

FIG. 1 shows an example of a sound field correction apparatus according to an embodiment of the present invention. In this example, a case where the sound field correction apparatus is formed in an adaptor form with respect to a known multichannel AV playback apparatus is shown.

An example of the playback apparatus will be described.

Referring to FIG. 1, the AV playback apparatus includes a signal source 11 for AV signals, a display 12, a digital amplifier 13, and speakers 14C to 14RB. In this case, the signal source 11 is a tuner for a digital versatile disc (DVD) player, satellite broadcasting, and the like. In addition, in the example shown in FIG. 1, output from the signal source 11 is in a digital visual interface (DVI) format. The signal source 11 outputs a digital video signal DV, and at the same time, outputs a serial signal DA acquired by encoding digital audio signals for seven channels.

In addition, input to the display 12 is in the DVI format. Thus, the display 12 should be able to receive a digital video signal DV output from the signal source 11. In addition, in the example shown in FIG. 1, the digital amplifier 13 includes a multichannel decoder. The digital amplifier 13 is a so-called class D amplifier. That is, the digital amplifier 13 should be able to receive a digital audio signal DA output from the signal source 11. The digital amplifier 13 separates the digital audio signal DA into signals for individual channels, and at the same time, performs class D power amplification on the signals for the individual channels to output analog audio signals for the individual channels.

The audio signals output from the digital amplifier 13 are supplied to the speakers 14C to 14RB for the individual channels. The speakers 14C to 14RB are disposed at the center front, left front, right front, left, right, left back, and right back of a listener.

An example of the structure of the sound field correction apparatus will be described.

Referring to FIG. 1, reference numeral 20 denotes the sound field correction apparatus according to the embodiment of the present invention. The sound field correction apparatus 20 is connected to a signal line between the signal source 11 and each of the display 12 and the digital amplifier 13. A digital video signal DV output from the signal source 11 is supplied to the display 12 via a delay circuit 21. The delay circuit 21 is provided for achieving so-called lip sync in which, in order to synchronize an image with playback sound, the digital video signal DV is delayed by a period of time corresponding to a delay time of a digital audio signal DA due to sound field correction processing. The delay circuit 21 includes a field memory and the like.

In addition, in the sound field correction apparatus 20, the digital audio signal DA output from the signal source 11 is supplied to a decoder circuit 22 and is separated into digital audio signals DC to DRB for individual channels. An audio signal DC for a center channel from among the digital audio signals DC to DRB is supplied to a correction circuit 23C for the center channel. The correction circuit 23C includes an equalizer circuit 231 and a switch circuit 232. The audio signal DC is supplied from the decoder circuit 22 to the switch circuit 232 via the equalizer circuit 231.

In this case, the equalizer circuit 231 includes, for example, a digital signal processor (DSP). The equalizer circuit 231 performs sound field correction processing on the audio signal DC supplied to the equalizer circuit 231 by controlling the delay characteristics, frequency characteristics, phase characteristics, level, and the like of the audio signal DC. In a normal viewing and listening condition, the switch circuit 232 is connected, as shown in FIG. 1. When measurement and analysis for sound field correction are performed, the switch circuit 232 is connected in a way that is opposite from the way shown in FIG. 1. Thus, in the normal viewing and listening condition, the audio signal DC on which sound field correction has been performed by the equalizer circuit 231 is output from the switch circuit 232. The audio signal DC on which sound field correction has been performed is supplied to an encoder 24.

The audio signals DL to DRB for the other channels acquired by the decoder circuit 22 are supplied to the encoder 24 via correction circuits 23L to 23RB. The correction circuits 23L to 23RB are formed similarly to the correction circuit 23C. Thus, in the normal viewing and listening condition, the audio signals DL to DRB on which sound field correction has been performed are output from the correction circuits 23L to 23RB, and are supplied to the encoder 24.

In the encoder 24, the audio signals DC to DRB for the individual channels supplied to the encoder 24 are combined into a single serial signal DS, and the serial signal DS is supplied to the digital amplifier 13. Thus, in the normal viewing and listening condition, the audio signal DA output from the signal source 11 is subjected to sound field correction by the correction circuits 23C to 23RB and then output to the speakers 14C to 14RB. As a result, sound output from the speakers 14C to 14RB is playback sound on which sound field correction has been performed so as to be suitable for environment in which the speakers are disposed.

In addition, the sound field correction apparatus 20 includes a test signal generation circuit 31 that generates a test tone signal. The test signal generation circuit 31 includes a memory in which a test tone signal is written in a digital data format and a read circuit. The test signal generation circuit 31 generates a test tone signal under the control of a control circuit 35. The generated test tone signal is supplied to switch circuits 232 of the correction circuits 23C to 23RB. The test signal may be an impulse signal, a TSP signal, or a burst wave signal, as described above.

Figure 2:
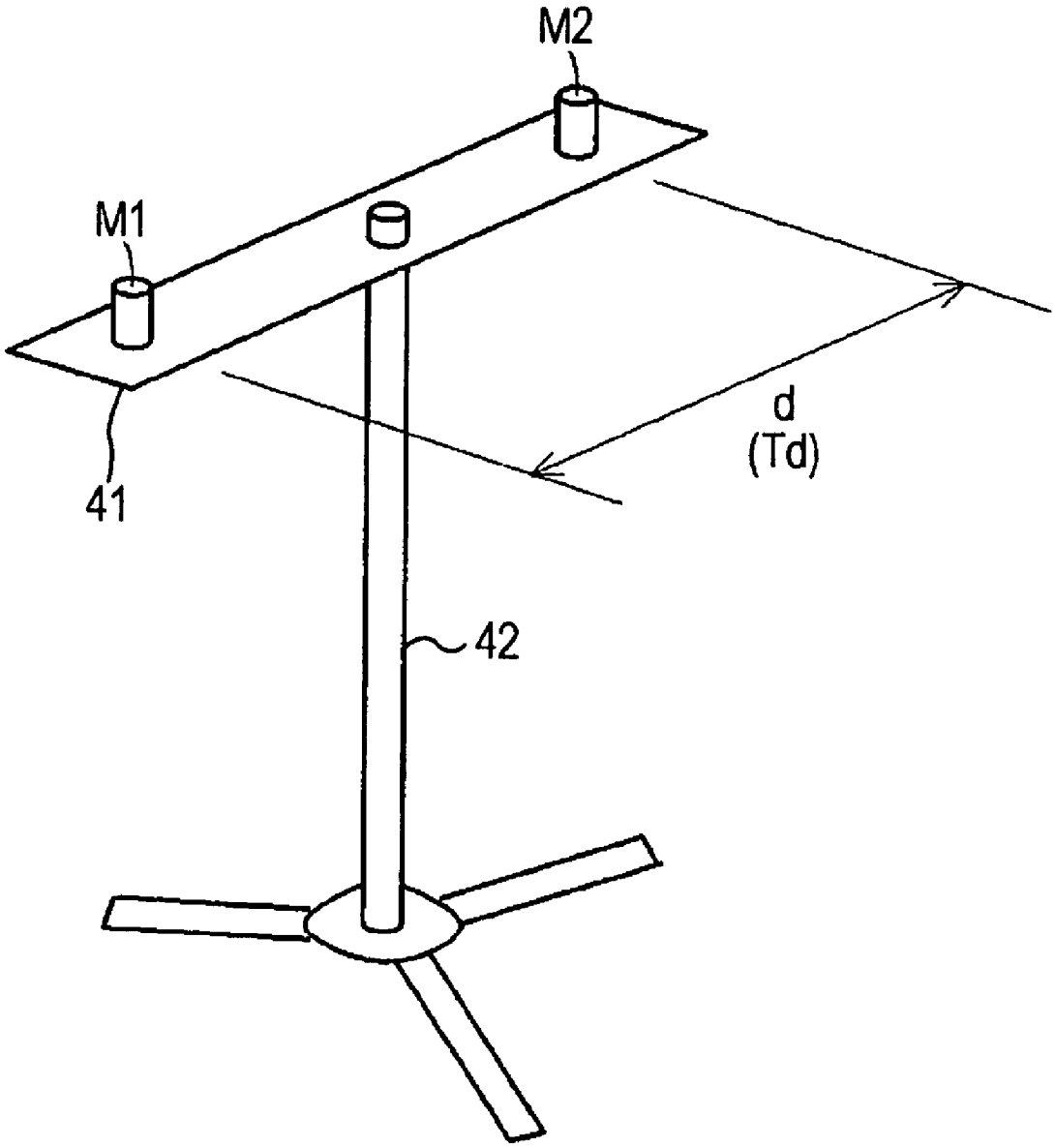
FIG. 2 is a perspective view showing a setting example of microphones.

In addition, since a test tone signal is picked up as described above, when acoustic conditions of a playback sound field are measured, the microphones M1 and M2 are disposed at the positions of a listener. As shown in FIG. 2, the microphones M1 and M2 are supported by ends of a predetermined arm 41, and the center of the arm 41 is supported by a microphone stand 42.

In this case, the microphones M1 and M2 are pair microphones having equivalent frequency characteristics and sensitivities. The microphones M1 and M2 are supported by the arm 41 such that the microphones M1 and M2 are disposed on the same horizontal plane. In addition, the microphones M1 and M2 are disposed such that vibration plates of the microphones M1 and M2 are within a horizontal plane. With this arrangement, as directional characteristics on a horizontal plane, non-directionality is achieved. Thus, a constant sensitivity can be achieved irrespective of the arrangement direction of speakers.

The distance d between the microphones M1 and M2 is fixed. When the distance d increases, the accuracy in calculating the distance between a speaker and each of the microphones M1 and M2 is improved. However, a too large distance d is inconvenient for setting and accommodation of the microphones M1 and M2. In this example, taking into consideration the distance between the ears of human beings, the distance d is set to 18 cm, as mentioned above. The distance d (=18 cm) corresponds to the time period Td (=0.53 milliseconds), as mentioned above. Devices for stereo recording can be used for the microphones M1 and M2, the arm 41, and the microphone stand 42.

The output signals SM1 and SM2 of the microphones M1 and M2 are supplied via microphone amplifiers 321 and 322 to analog-to-digital (A/D) converter circuits 331 and 332, respectively. The A/D converters 331 and 332 convert the output signals SM1 and SM2 into digital signals SM1 and SM2 having a sampling frequency of, for example, 48 kHz. The digital signals SM1 and SM2 are supplied to an analysis determination circuit 34.

The analysis determination circuit 34 includes a memory 341 and a DSP 342. At the start of a test tone signal, the output signals SM1 and SM2 are stored in order during a predetermined period of time, such as a 4096-sample period. In addition, the DSP 342 analyzes the output signals SM1 and SM2 stored in the memory 341 in accordance with the determination method described above, and determines the amplitudes P1 and P2 corresponding to the direct waves W1 and W2.

When the sampling frequency of the output signals SM1 and SM2 is 48 kHz, the 4096-sample period is calculated as follows: 4096/48000≈85.3 [ms]. When the acoustic velocity in the air is 340 m/s, the distance an acoustic wave reaches is calculated as follows: 340 [m/s]×85.3 [ms]≈[m]. Thus, this arrangement is sufficiently suitable for a room in which AV playback is generally performed.

An analysis result acquired by the analysis determination circuit 34 is supplied to the control circuit 35. The control circuit 35 includes a microcomputer. The control circuit 35 controls the test signal generation circuit 31 to generate a test tone signal, and controls switching operations of the switch circuits 232. In addition, in accordance with the analysis result acquired by the analysis determination circuit 34, the control circuit 35 sets the equalizer circuits 231 of the correction circuits 23C to 23RB.

As user interfaces, various operation switches 36 are connected to the control circuit 35. In addition, a display device that displays an analysis result or the like, such as a liquid crystal display (LCD) panel 37, is connected to the control circuit 35.

An operation when the sound field correction apparatus 20 performs analysis determination will be described.

When a setting switch from among the operation switches 36 is operated, the switch circuits 232 of the correction circuits 23C to 23RB are connected in a way that is opposite from the way shown in FIG. 1 under the control of the control circuit 35. The control circuit 35 controls the test signal generation circuit 31 to supply a test tone signal to the switch circuit 232 of the correction circuit 23C. Thus, a test tone is output from the speaker 14C, and no sound is output from speakers for the other channels.

The test tone output from the speaker 14C at that time is picked up by the microphones M1 and M2. In addition, the control circuit 35 controls the analysis determination circuit 34 to start analysis determination. Thus, the analysis determination circuit 34 correctly determines the amplitudes P1 and P2 corresponding to the direct waves W1 and W2 in accordance with the determination method described above.

In accordance with the determination result, the distance with respect to each of the microphones M1 and M2 is calculated, and information on the calculated distance is supplied to the control circuit 35. The control circuit 35 sets sound field correction of the equalizer circuit 231 in accordance with information on the distance and angle. Then, the switch circuit 232 is connected as shown in FIG. 1, and sound field correction on the channel for the audio signal DC is terminated. Then, similar setting of sound field correction is performed for the other channels.

The sound field correction performed here is called time alignment (time delay correction). The sound field correction includes correction processing for performing correction such that acoustic waves from individual channels reach a microphone at the same timing, equalizer processing for correcting frequency balance of acoustic waves from the individual speakers, processing for correcting volume valance, and the like.

Thus, in the normal viewing and listening condition, an audio signal DA output from the signal source 11 is subjected to sound field correction by the correction circuits 23C to 23RB and then supplied to the speakers 14C to 14RB. Thus, sound output from the speakers 14C to 14RB is playback sound on which sound field correction has been performed so as to be suitable for environment in which the speakers 14C to 14RB are disposed.

A routine for realizing the determination method explained above will be described.

Figure 3:
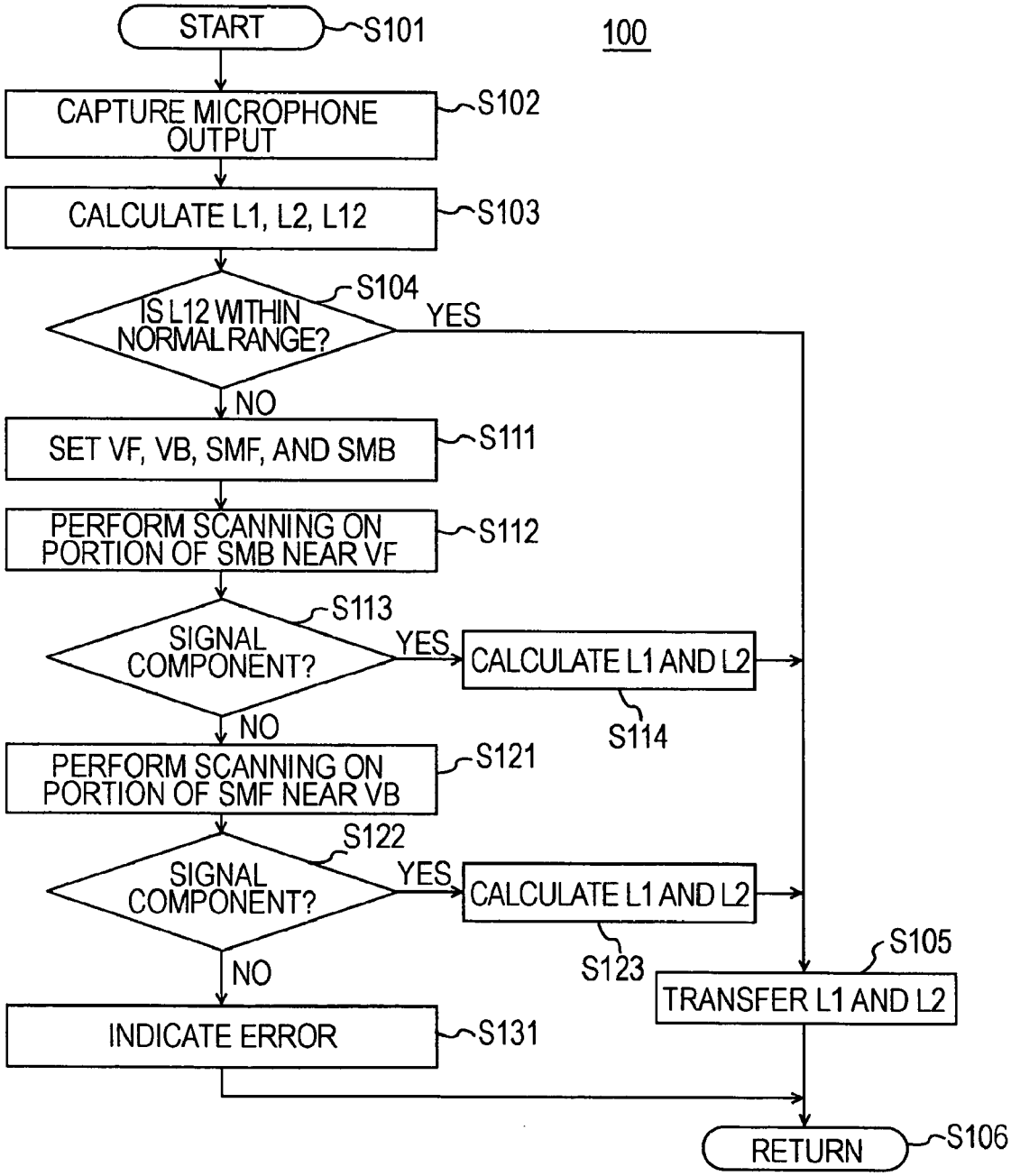
FIG. 3 is a flowchart showing an example of a processing routine according to the embodiment of the present invention.
Figure 4A:
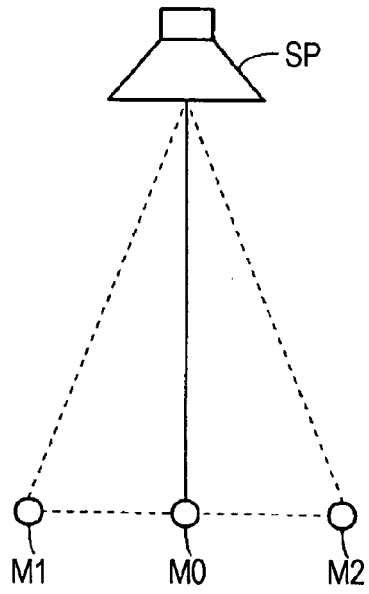
FIGS. 4A and 4B are plan views for explaining the embodiment of the present invention.
Figure 4B:
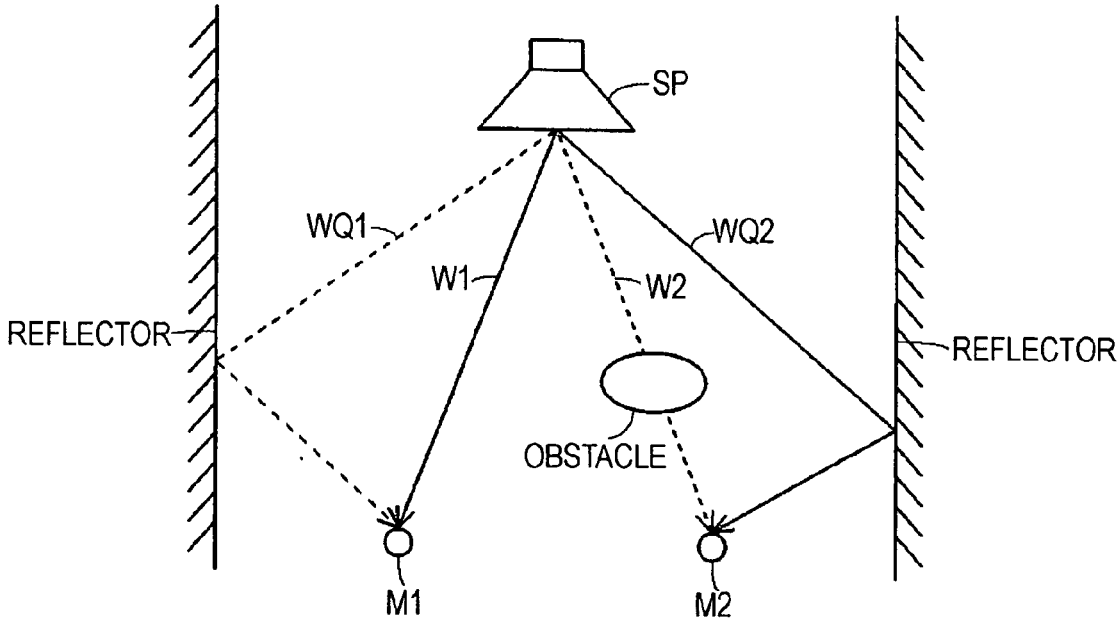

FIG. 3 is a flowchart showing an example of a routine 100 for realizing the determination method explained above. The routine 100 is performed for each channel by the DSP 342 of the analysis determination circuit 34. In this example, "L1" represents the distance from the speaker SP to the microphone M1, and "L2" represents the distance from the speaker SP to the microphone M2.

When the control circuit 35 instructs starting of analysis determination processing, the DSP 342 starts the routine 100 in step S101. Then, in step S102, the output signals SM1 and SM2 from the A/D converter circuits 331 and 332 are captured into the memory 341 in order during, for example, a 4096-sample period.

In step S103, as shown in FIG. 5, the distance L1 from the speaker SP to the microphone M1, the distance L2 from the speaker SP to the microphone M2, and the distance difference L12 (=|L1−L2|) between the distances L1 and L2 are calculated by analyzing the amplitudes V1 and V2 that first exceed the threshold level VTH of the signals SM1 and SM2 stored in the memory 341.

In step S104, it is determined whether or not the distance difference L12 calculated in step S103 is within a normal range, that is, whether or not the distance difference L12 is smaller than or equal to the distance d between the microphones M1 and M2. If the distance difference L12 is smaller than or equal to the distance d (that is, the time difference T12 is smaller than or equal to the time period Td), the amplitude V1 is equal to the amplitude P1, and the amplitude V2 is equal to the amplitude P2. Thus, the process proceeds to step S105. In step S105, the distances L1 an L2 calculated by step S103 are supplied to the control circuit 35. In step S106, processing on the current channel is terminated.

If it is determined in step S104 that the distance difference L12 is larger than the distance d, the process proceeds to step S111. In step S111, one of the amplitudes V1 and V2 that is acquired earlier is set as amplitude VF, the other one of the amplitudes V1 and V2 that is acquired later is set as amplitude VB, one of the output signals SM1 and SM2 that includes the amplitude VF is set as an output signal SMF, and the other one of the output signals SM1 and SM2 that includes the amplitude VB is set as an output signal SMB. In the case shown in FIG. 5A, the following conditions are set: VF=V1=P1, VB=V2=Q2, SMF=SM1, and SMB=SM2. In the case shown in FIG. 5B, the following conditions are set: VF=V2=R2, VB=V1=P1, SMF=SM2, and SMB=SM1.

In step S112, scanning is performed on a portion of the output signal SMB corresponding to a check period ±Td near the amplitude VF. At that time, the threshold level VTH is set to be lower. Thus, in the case shown in FIG. 5A, scanning is performed on a portion of the output signal SM2 corresponding to a check period ±Td near the amplitude V1 (=P1), and the amplitude P2 is detected. In the case shown in FIG. 5B, scanning is performed on a portion of the output signal SM1 corresponding to a check period ±Td near the amplitude V2 (=R2), and no amplitude is detected.

In step S113, it is determined whether or not an amplitude has been detected by scanning performed in step S112. If it is determined in step S113 that an amplitude has been detected, the process proceeds to step S114. If no amplitude has been detected, the process proceeds to step S121. Since, in the case shown in FIG. 5A, the amplitude P1 is detected, the process proceeds to step S114. Since, in the case shown in FIG. 5B, no amplitude is detected, the process proceeds to step S121.

In the case shown in FIG. 5A, in step S114, the distances L1 and L2 are calculated in accordance with the amplitude VF (=P1) set by step S111 and the detection result acquired by scanning performed in step S112 that the amplitude P2 is equal to the amplitude VB (=P2). Then, in step S105, the distances L1 and L2 calculated by step S114 are supplied to the control circuit 35. Then, in step S106, processing on the current channel is terminated.

In the case shown in FIG. 5B, in step S121, scanning is performed on a portion of the output signal SMF (=SM2) corresponding to a check period ±Td near the amplitude VB (=V1=P1). Thus, the amplitude P2 is detected.

In step S122, it is determined whether or not an amplitude has been detected by scanning performed in step S121. In this case, since the amplitude P2 is detected, the process proceeds to step S123. In step S123, the distances L1 and L2 are calculated in accordance with the amplitude P2 detected by scanning performed in step S121 and the amplitude V1 (=P1) set by step S111. Then, in step S105, the distances L1 and L2 calculated in step S123 are supplied to the control circuit 35, and processing on the current channel is terminated in step S106.

If it is determined in step S122 that no amplitude has been detected by scanning performed in step S121, the process proceeds to step S131. In step S131, an error is indicated on the LCD panel 37, and report indicating that failure occurs in the installation conditions of the microphones M1 and M2 or the speaker SP is given.

According to the routine 100, the distances L1 and L2 from the speaker SP to the microphones M1 and M2 can be calculated correctly in accordance with the amplitudes P1 and P2 corresponding to the direct waves W1 and W2. In addition, the measurement results are hardly affected by reflectors, obstacles, noise, pre-echo, or the like.

According to the above-described system, when the distance L1 from the speaker SP to the microphone M1, the distance L2 from the speaker SP to the microphone M2, and the angle between the speaker SP and each of the microphones M1 and M2 are calculated, even if a reflector or an obstacle is disposed in a playback sound field or even if noise or pre-echo occurs, the direct waves W1 and W2 can be correctly determined. Thus, the distances L1 and L2 and the angles can be correctly measured. Thus, sound field correction can be performed properly.

Although a case where the microphones M1 and M2 are disposed on the same horizontal plane has been explained, another microphone may be disposed in the same vertical plane as the microphone M1 or M2 so that distance can be calculated similarly. In addition, a common DSP may be used in the equalizers 231 of the correction circuit 23C to 23RB.

It should be understood by those skilled in the art that various modifications, combinations, sub-combinations and alterations may occur depending on design requirements and other factors insofar as they are within the scope of the appended claims or the equivalents thereof.

What is claimed is:

1. A test tone determination method comprising the steps of:

picking up, by a first microphone and a second microphone that are disposed with a predetermined distance therebetween, a test tone output from a speaker;

calculating a first distance from the speaker to the first microphone, a second distance from the speaker to the second microphone, and a distance difference between the first and second distances, in accordance with periods of time necessary for occurrence of a first amplitude and a second amplitude that are larger than a predetermined value in output signals of the first and second microphones;

determining whether or not the distance difference is less than or equal to the predetermined distance;

determining the first and second amplitudes to be amplitudes corresponding to direct waves of the test tone, when the distance difference is less than or equal to the predetermined distance in accordance with a determination result of the distance difference;

performing scanning, with respect to one of the first and second amplitudes that is found later, on a first output signal portion corresponding to a second output signal portion near the other one of the first and second amplitudes that is found earlier, when the distance difference is larger than the predetermined distance in accordance with the determination result of the distance difference; and determining an amplitude found in both the first output signal portion corresponding to the second output signal portion to be amplitudes corresponding to the direct waves of the test tone, when the amplitude found in the output signal portion corresponding to the output signal portion near the other one of the first and second amplitudes that is found earlier is found in accordance with a scanning result.

2. The test tone determination method according to claim 1, wherein:

when no amplitude is found in the first output signal portion corresponding to the second output signal portion scanning is performed, with respect to the other one of the first and second amplitudes that is found earlier, on the second output signal portion corresponding to the first output signal portion near the one of the first and second amplitudes that is found later; and when an amplitude is found in the second output signal portion corresponding to the first output signal portion the amplitude found in the output signal portion corresponding to the output signal portion near the one of the first and second amplitudes that is found later and the one of the first and second amplitudes that is found later are determined to be amplitudes corresponding to the direct waves of the test tone.

3. The test tone determination method according to claim 1, wherein the test tone is an impulse signal, a time stretched pulse signal, or a burst wave signal.

4. A test tone determination method comprising the steps of:

picking up, by a first microphone and a second microphone that are disposed with a predetermined distance therebetween, a test tone output from a speaker;

calculating periods of time necessary for occurrence of a first amplitude and a second amplitude that are larger than a predetermined value in output signals of the first and second microphones and a time difference between the periods of time;

determining whether or not the calculated time difference is smaller than or equal to a period of time corresponding to the predetermined distance;

determining the first and second amplitudes to be amplitudes corresponding to direct waves of the test tone, when the time difference is less than or equal to the period of time corresponding to the predetermined distance in accordance with a determination result of the time difference;

performing scanning, with respect to one of the first and second amplitudes that is found later, on a first output signal portion corresponding to a second output signal portion near the other one of the first and second amplitudes that is found earlier, when the time difference is larger than the period of time corresponding to the predetermined distance in accordance with the determination result of the time difference; and determining an amplitude found in both the first output signal portion corresponding to the second output signal portion to be amplitudes corresponding to the direct waves of the test tone, when the amplitude found in the output signal portion corresponding to the output signal portion near the other one of the first and second amplitudes that is found earlier is found in accordance with a scanning result.

5. The test tone determination method according to claim 4, wherein:

when no amplitude is found in the first output signal portion corresponding to the second output signal portion scanning is performed, with respect to the other one of the first and second amplitudes that is found earlier, on the second output signal portion corresponding to the first an output signal portion near the one of the first and second amplitudes that is found later; and when an amplitude is found in the second output signal portion corresponding to the first output signal portion the amplitude found in the output signal portion corresponding to the output signal portion near the one of the first and second amplitudes that is found later and the one of the first and second amplitudes that is found later are determined to be amplitudes corresponding to the direct waves of the test tone.

6. The test tone determination method according to claim 4, wherein the test tone is an impulse signal, a time stretched pulse signal, or a burst wave signal.

7. A sound field correction apparatus comprising:

a signal generation circuit that generates a test tone signal for measuring sound field characteristics;

an output circuit that selects one of an input audio signal and the test tone signal from the signal generation circuit and that outputs the selected one of the input audio signal and the test tone signal to a speaker;

an analysis determination circuit that picks up, via a first microphone and a second microphone that are disposed with a predetermined distance therebetween, a test tone output from the speaker and that analyzes output signals of the first and second microphones to calculate a first distance from the speaker to the first microphone and a second distance from the speaker to the second microphone; and a sound field correction circuit that performs at least delay processing on the input audio signal in accordance with the first and second distances calculated by the analysis determination circuit, wherein analysis processing of the analysis determination circuit is performed such that the first and second distances and a distance difference between the first and second distances are calculated in accordance with periods of time necessary for occurrence of a first amplitude and a second amplitude that are larger than a predetermined value in the output signals of the first and second microphones, such that it is determined whether or not the calculated distance difference is less than or equal to the predetermined distance, such that it is determined that the first and second amplitudes are amplitudes corresponding to direct waves of the test tone when the distance difference is less than or equal to the predetermined distance in accordance with a determination result of the distance difference, such that scanning is performed, with respect to one of the first and second amplitudes that is found later, on a first output signal portion corresponding to a second output signal portion near the other one of the first and second amplitudes that is found earlier, when the distance difference is larger than the predetermined distance in accordance with the determination result of the distance difference, and such that it is determined that an amplitude found in both the first output signal portion corresponding to the second output signal portion are amplitudes corresponding to the direct waves of the test tone, when the amplitude found in the output signal portion corresponding to the output signal portion near the other one of the first and second amplitudes that is found earlier is found in accordance with a scanning result.

8. A sound field correction apparatus comprising:

a signal generation circuit that generates a test tone signal for measuring sound field characteristics;

an output circuit that selects one of an input audio signal and the test tone signal from the signal generation circuit and that outputs the selected one of the input audio signal and the test tone signal to a speaker;

an analysis determination circuit that picks up, via a first microphone and a second microphone that are disposed with a predetermined distance therebetween, a test tone output from the speaker and that analyzes output signals of the first and second microphones to calculate a time difference between the speaker to the first microphone and the speaker to the second microphone; and a sound field correction circuit that performs at least delay processing on the input audio signal in accordance with the time difference calculated by the analysis determination circuit, wherein analysis processing of the analysis determination circuit is performed such that periods of time necessary for occurrence of a first amplitude and a second amplitude that are larger than a predetermined value in the output signals of the first and second microphones and the time difference between the periods of time are calculated, such that it is determined whether or not the calculated time difference is less than or equal to a period of time corresponding to the predetermined distance, such that it is determined that the first and second amplitudes are amplitudes corresponding to direct waves of the test tone when the time difference is less than or equal to the period of time corresponding to the predetermined distance in accordance with a determination result of the time difference, such that scanning is performed, with respect to one of the first and second amplitudes that is found later, on a first output signal portion corresponding to a second output signal portion near the other one of the first and second amplitudes that is found earlier, when the time difference is larger than the period of time corresponding to the predetermined distance in accordance with the determination result of the time difference, and such that it is determined that an amplitude found in both the first output signal portion corresponding to the second output signal portion are amplitudes corresponding to the direct waves of the test tone, when the amplitude found in the output signal portion corresponding to the output signal portion near the other one of the first and second amplitudes that is found earlier is found in accordance with a scanning result.

* * * * *